US005630589A

United States Patent [19]

Adie et al.

[11] Patent Number: 5,630,589

[45] Date of Patent: May 20, 1997

[54] APPARATUS AND METHOD OF PLAYING A PADDLE BALL GAME

[76] Inventors: William S. Adie; Ian Adie, both of 6854 Bellflower Ct., Mentor, Ohio 44060; Steven D. Goldenbogen, 733 Broughton St., Pittsburgh, Pa. 15213

[21] Appl. No.: 610,467

[22] Filed: Mar. 1, 1996

[51] Int. Cl.[6] ..... A63B 67/00

[52] U.S. Cl. ..... 473/474

[58] Field of Search ..... 273/411, 336

[56] References Cited

U.S. PATENT DOCUMENTS

| | | | |
|---|---|---|---|
| 424,322 | 3/1890 | Malings et al. | 273/411 X |
| 1,509,490 | 9/1924 | Sawyer | 273/411 |
| 3,945,641 | 3/1976 | Carbonero | 273/411 |
| 4,415,163 | 11/1983 | Schoenig | 273/411 |
| 4,717,157 | 1/1988 | Smith | 273/411 |
| 5,058,899 | 10/1991 | Jackson et al. | 273/411 |
| 5,135,232 | 8/1992 | Moreau | 273/336 |
| 5,316,315 | 5/1994 | Roark, Jr. | 273/411 |
| 5,326,109 | 7/1994 | Robl | 273/411 |
| 5,385,350 | 1/1995 | Norman | 273/29 B |

*Primary Examiner*—William H. Grieb

*Attorney, Agent, or Firm*—David L. Volk; Brendan B. Dix

[57] ABSTRACT

Two posts have a thin, flexible barrier attached therebetween. The barrier spans a hard playing surface which may be a driveway. Each post is supported from the ground in a substantially vertical position. The barrier includes a cord laced through grommets along the top edge of the barrier to hold the barrier in position. Two players use paddles to hit a projectile back and forth. A method of playing the paddle ball game is disclosed.

7 Claims, 7 Drawing Sheets

APPARATUS AND METHOD OF PLAYING A PADDLE BALL GAME

BACKGROUND—FIELD OF INVENTION

This invention relates to a game, specifically a game wherein players use paddles to hit a projectile back and forth over a barrier.

BACKGROUND—DESCRIPTION OF PRIOR ART

Presently, there are paddle ball games available for children to play in the driveways of their family residences. Typically, these games include a net or barrier which is supported between plastic posts. The posts are on plastic, movable stands, intended to rest on the driveway surface. Plastic paddies and a plastic or foam ball are included.

The posts and stands are generally light in weight. The posts are not anchored to the ground in any way, relying only on the plastic stands for stability. Subsequently, the posts are able to support the weight of a net or barrier which spans only about 8 feet when fully extended between the posts. A net of a longer dimension would be likely to be so heavy as to cause the posts to tip over. This limitation makes the game suitable only for children.

The plastic paddles, being very light in weight, are suitable for the children's game described above, but would not be suitable for an adult paddle ball game including a larger playing area and requiring the ball to travel a greater distance with each hit.

There exists a need for an apparatus and rules for a paddle ball game which can be played in a driveway by both children and adults, involving a larger play area.

SUMMARY

The paddle ball game of the present invention includes two posts having a thin, flexible barrier attached therebetween. Each post is supported from the ground in a substantially vertical position. The barrier includes a cord laced through grommets along the top edge of the barrier to hold the barrier in position. The paddle ball game further includes two paddles and a projectile. A method of playing the paddle ball game is disclosed.

The configuration, dimension, materials and weights of the game apparatus work synergistically with the rules for playing such that the game is suitable for play by children or adults using a residential driveway as the playing area.

DETAILED DESCRIPTION

Figure 1:
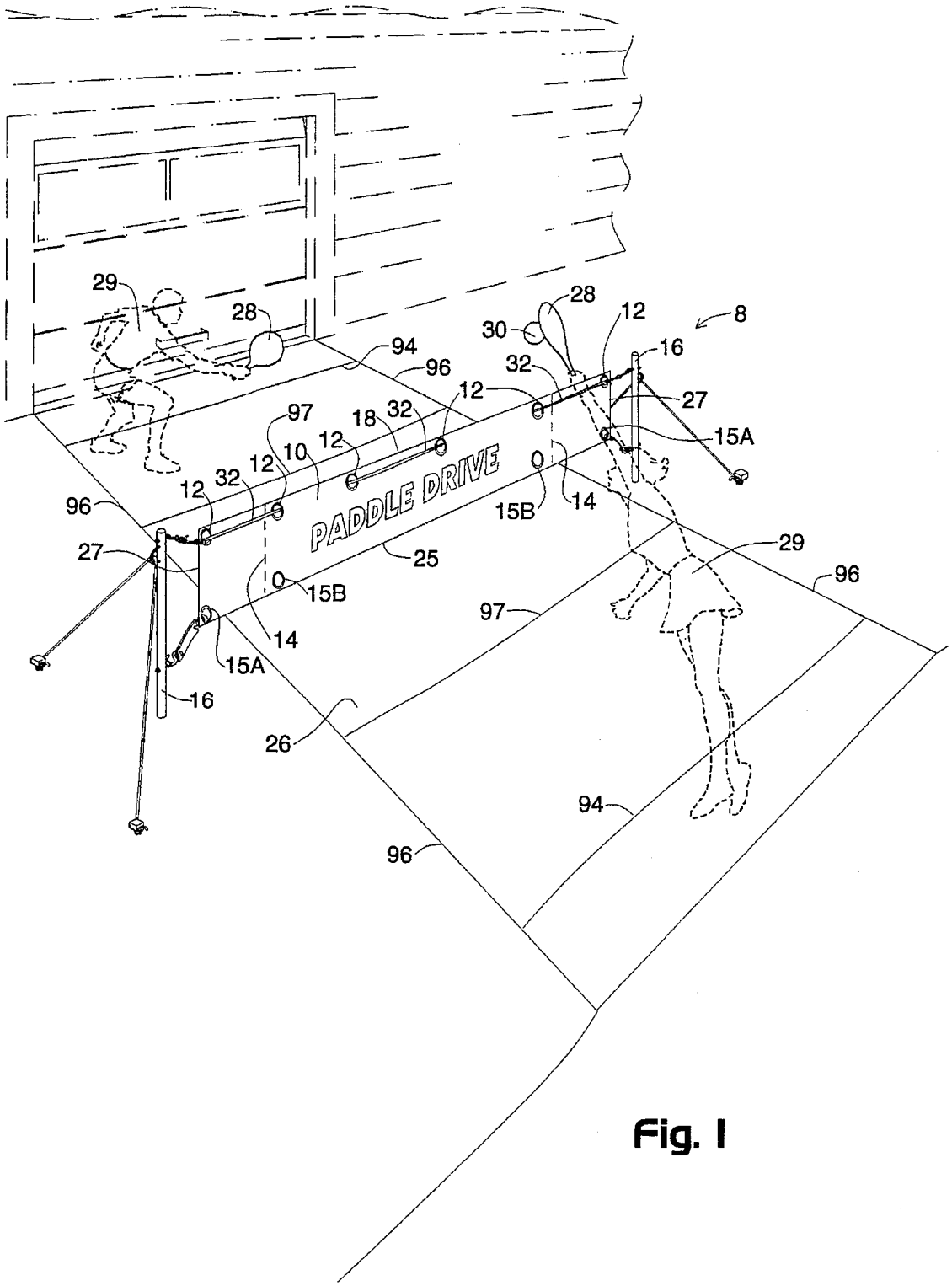
FIG. 1 is a perspective view of the paddle ball game apparatus in use.

FIG. 1 is a perspective view of a paddle ball game apparatus 8 in use, showing two posts 16 supporting a thin, flexible, substantially rectangular barrier 10, the barrier 10 extending substantially across a hard surface 26. The hard surface 26 may be a driveway. The posts 16 are mounted such that they extend substantially perpendicular to the plane of the hard surface 26. The barrier 10 is supported by the posts 16 such that the plane of the barrier 10 is substantially perpendicular to the hard surface 26.

The barrier 10 is preferably constructed of plastic or nylon, and has a generally continuous surface on which text or graphics may by placed. The barrier may also be of any suitable material, and may be an open net.

In the preferred embodiment the posts 16 are about thirty-six inches long and the barrier 10 is installed such that a top edge 18 of the barrier 10 is about thirty-one inches above grade. The installed height of the barrier 10 above grade may vary from about eighteen to about thirty-six inches. If a different installed height of the barrier 10 is used, the length of the posts 16 may vary accordingly.

Two players 29 are shown using the paddle ball game apparatus 8. The players 29 are each holding paddles 28. The players 29 use the paddles 28 to hit a projectile 30 back and forth over the barrier 10.

Top grommets 12 are positioned along a top edge 18 of the barrier 10. The outermost top grommets 12 are positioned adjacent to an end 27 of the barrier 10. A cord 32 is laced through the top grommets 12 to hold the top edge 18 of the barrier 10 in position.

Figure 2A:
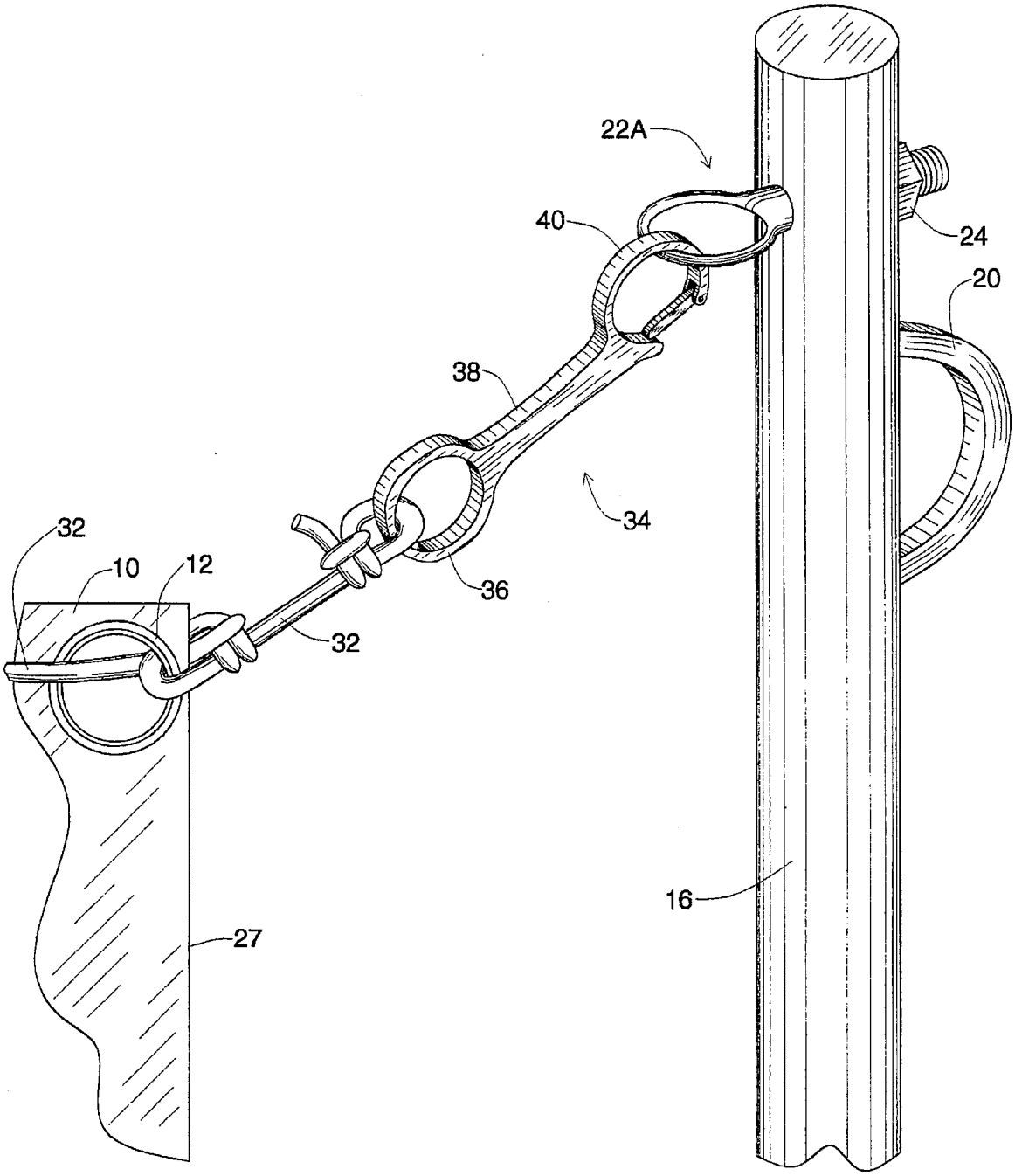
FIG. 2*a* is a partial perspective view of a typical post, showing the connection of the top of the barrier to the post.

FIG. 2*a* is a partial perspective view of one of the posts 16, showing the connection of the barrier 10 to the post 16 near the top edge 18 of the barrier 10. A barrier connector 34 includes a barrier connector body 38. The barrier connector body 38 has a ring 36 at a first end thereof, and a latch ring 40 at a second end thereof.

The cord 32 is tied to one of the outermost top grommets 12. The cord 32 is extended from the barrier 10 to the barrier connector 34. The cord 32 is tied to the ring 36 of the barrier connector 34. The latch ring 40 is connected to a first post connector 22A. The first post connector 22A is connected to the post 16.

Figure 2B:
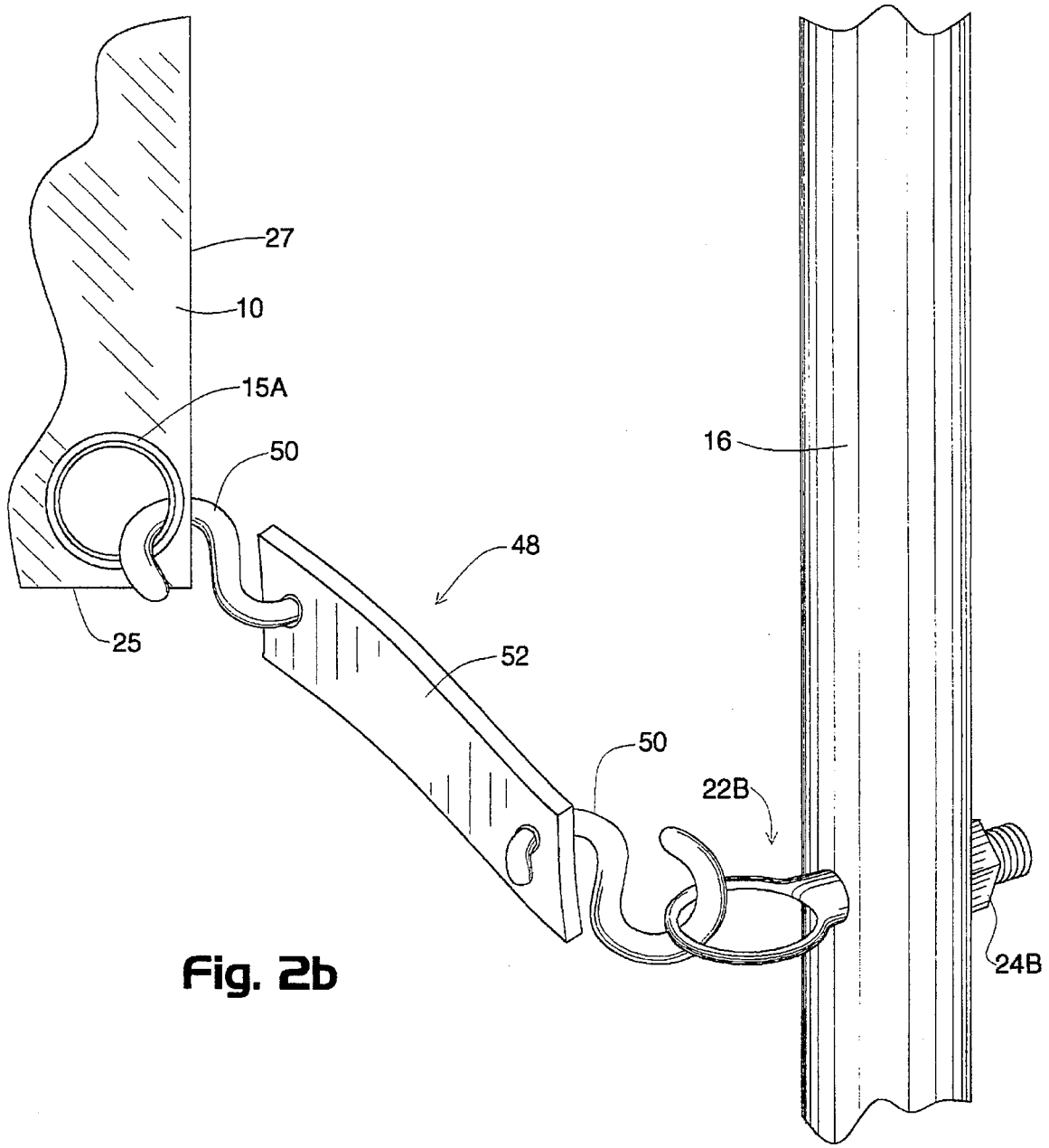
FIG. 2*b* is a partial perspective view of a typical post, showing the connection of the bottom of the barrier to the post.

FIG. 2*b* is a partial perspective view of one of the posts 16, showing the connection of the barrier 10 to the post 16 near a bottom edge 25 of the barrier 10. Referring to FIG. 1 and FIG. 2*b*, an outer bottom grommet 15A is positioned adjacent to each of the ends 27 of the barrier 10, near the bottom edge 25. An attachment device 48 includes an elongate elastic member 52. An S-hook 50 is attached to each end of the elastic member 52. One of the S-hooks 50 is hooked to the outer bottom grommet 15A. The other S-hook 50 is hooked to a second post connector 22B. The second post connector 22B is connected to the post 16.

Continuing to refer to FIG. 1 and FIG. 2*b*, an inner bottom grommet 15B is positioned a pre-determined distance inboard of each outer bottom grommet 15A. If the dimensions of the hard surface 26 require it, the barrier 10 may be shortened by cutting the barrier 10 along cut lines 14. The cut lines 14 are located outboard of and near inner bottom grommets 15B. The inner bottom grommets 15B would then be connected to the posts 16 as described above for the outer bottom grommets 15A. The cut lines 14 are not necessarily visible.

Referring back to FIG. 1, in the preferred embodiment: the top grommets 12 are spaced about 3 feet apart from one another along the top edge 18 of the barrier 10; a total of six top grommets 12 are included, making the total length of the barrier 10 slightly more than 15 feet; the outer bottom grommets 15A are each disposed substantially opposite one of the outermost top grommets 12; the inner bottom grommets 15B are each spaced three feet inboard of the outer bottom grommet 15A, and the inner bottom grommets 15B are each disposed substantially opposite one of said top grommets 12. The length of the barrier 10 and the spacing and number of the top grommets 12, the outer bottom grommets 15A and the inner bottom grommets 15B may vary from the parameters of the preferred embodiment and remain within the scope of the present invention.

Based on the above described dimensions of the preferred embodiment: if the barrier 10 is left uncut, it will span a hard surface 26 of about 15 feet in width; if the barrier 10 is cut along one of the cut lines 14, the barrier 10 will span a hard surface 26 of about 12 feet in width; and, if the barrier 10 is cut along both of the cut lines 14, the barrier 10 will span a hard surface 26 of about 8 to 10 feet in width.

Figure 3:
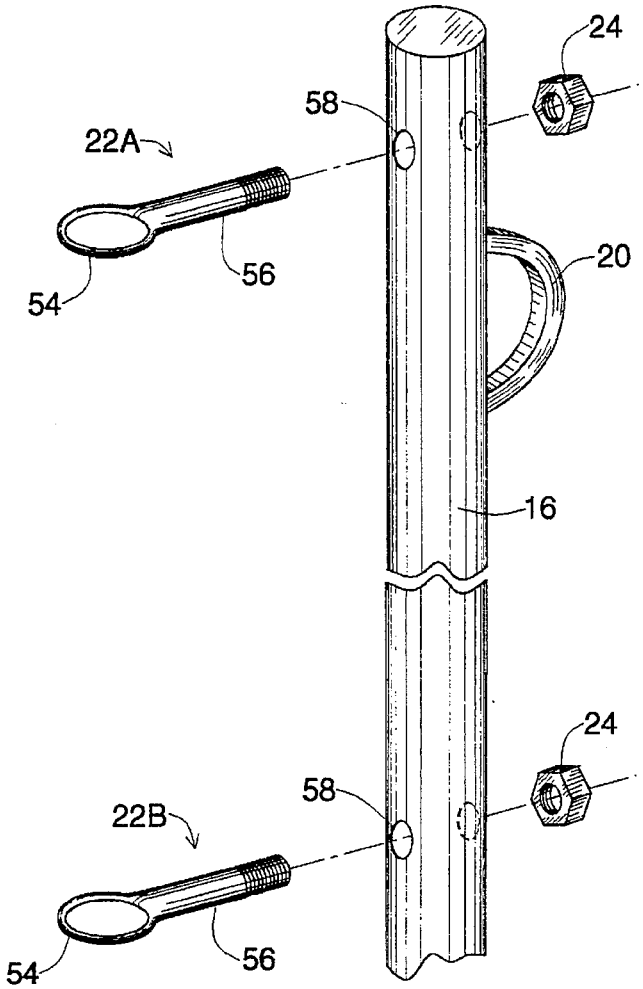
FIG. 3 is a partial perspective view of a typical post, showing the method of connecting the post connectors to the post.

FIG. 3 is a partial perspective view of one of the posts 16, showing the method of connecting the first post connector 22A and the second post connector 22B to the post 16. The first post connector 22A includes a slender, threaded post connector body 56. The post connector body 56 has a post connector ring 54 at one end thereof. The post 16 has structure forming a post hole 58 there-through. The post connector body 56 is inserted in the post hole 58. The first post connector 22A is secured to the post 16 by a nut 24 tightened to the post connector body 56. The second post connector 22B is configured similarly to the first post connector 22A, and is attached to the post 16 similarly to the first post connector 22A.

Figure 4:
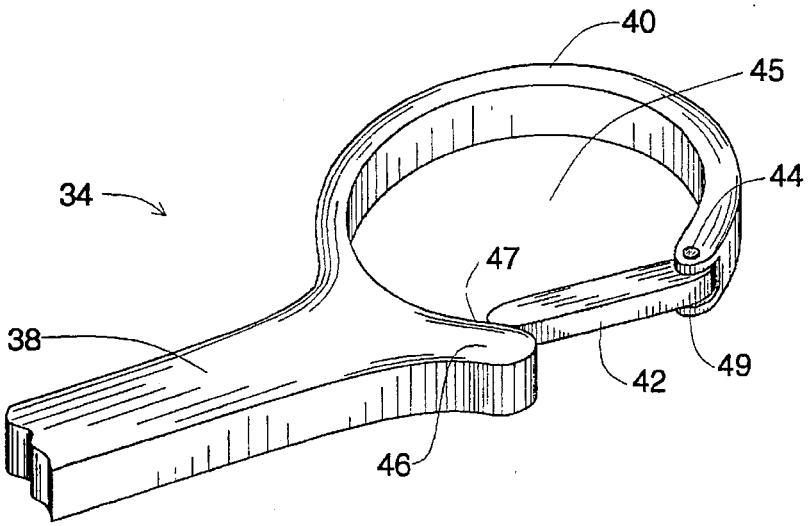
FIG. 4 is a partial perspective view of the barrier connector.

FIG. 4 is a partial perspective view of the barrier connector 34. The latch ring 40 is substantially c-shaped. A latch ring lip 46 depends outwardly from the intersection of the barrier connector body 38 and the latch ring 40. A gate 42 is pivotally attached to an extreme fixed end 49 of the latch ring 40 by a fastener 44. The gate 42 extends to an interior side 47 of the latch ring lip 46. The latch ring lip 46 restricts the gate 42 from movement past the latch ring lip 46 away from an interior 45 of the latch ring 40.

Referring to FIG. 2*a*, FIG. 3 and FIG. 4, the first post connector 22A is hooked to the latch ring 40 by first passing the post connector ring 54 past the gate 42 toward the interior 45 of the latch ring 40, then by urging the gate 42 against the latch ring lip 46.

Figure 5:
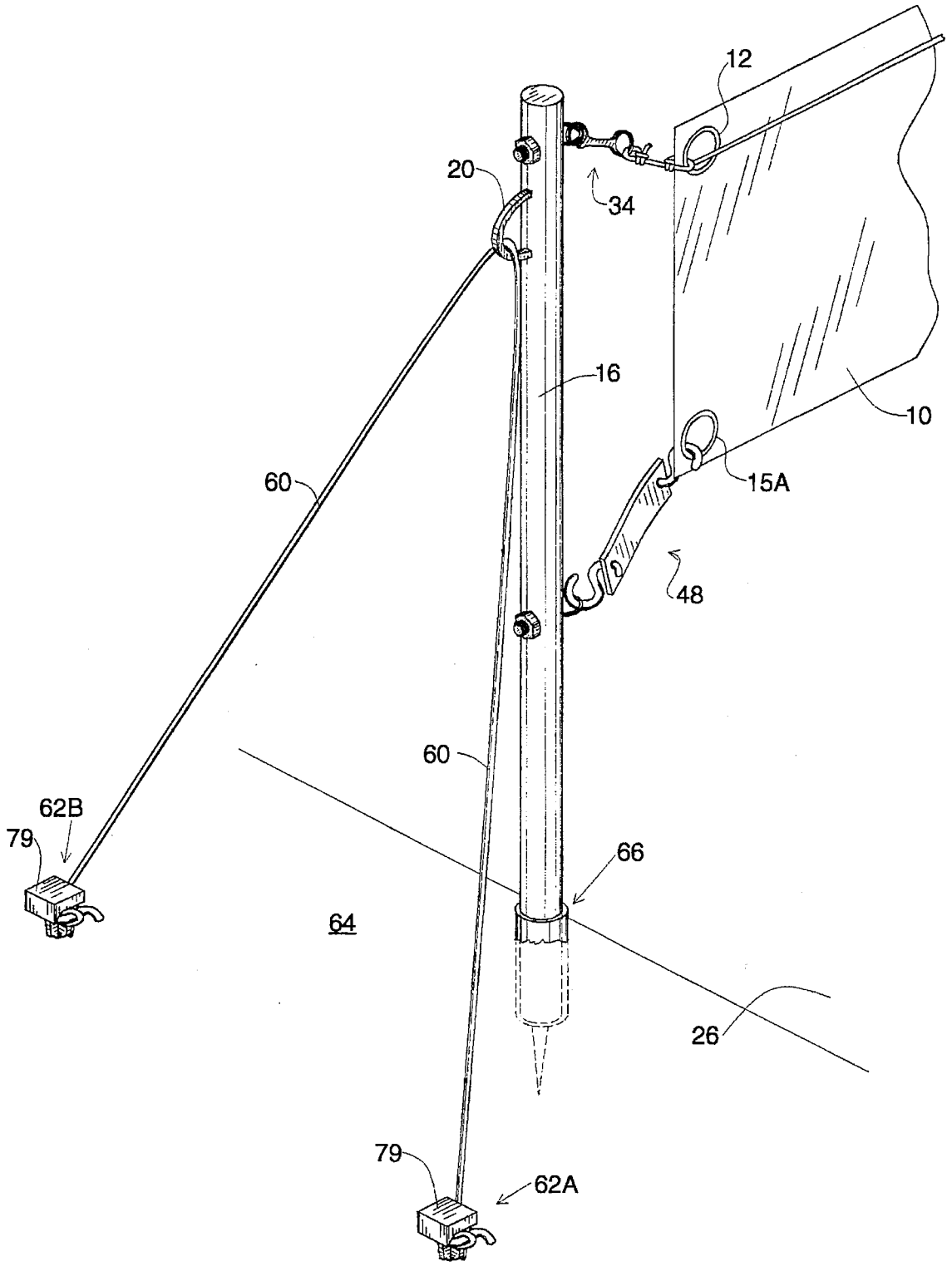
FIG. 5 is a partial perspective view of the post, shown mounted within the post support and anchored to the ground.

FIG. 5 is a partial perspective view of the post 16, shown inserted within a post support 66 and anchored to ground 64. A guide 20 is attached to the post 16 such that the guide 20 depends outwardly, away from the barrier 10 when the post 16 and the barrier 10 are installed. A first anchor 62A is driven into the ground 64. A slender member 60, which may be a rope or cord of any suitable material, is tied at one end to the anchor 62A. The slender member 60 extends through the guide 20 and is tied at another end to a second anchor 62B.

Figure 6A:
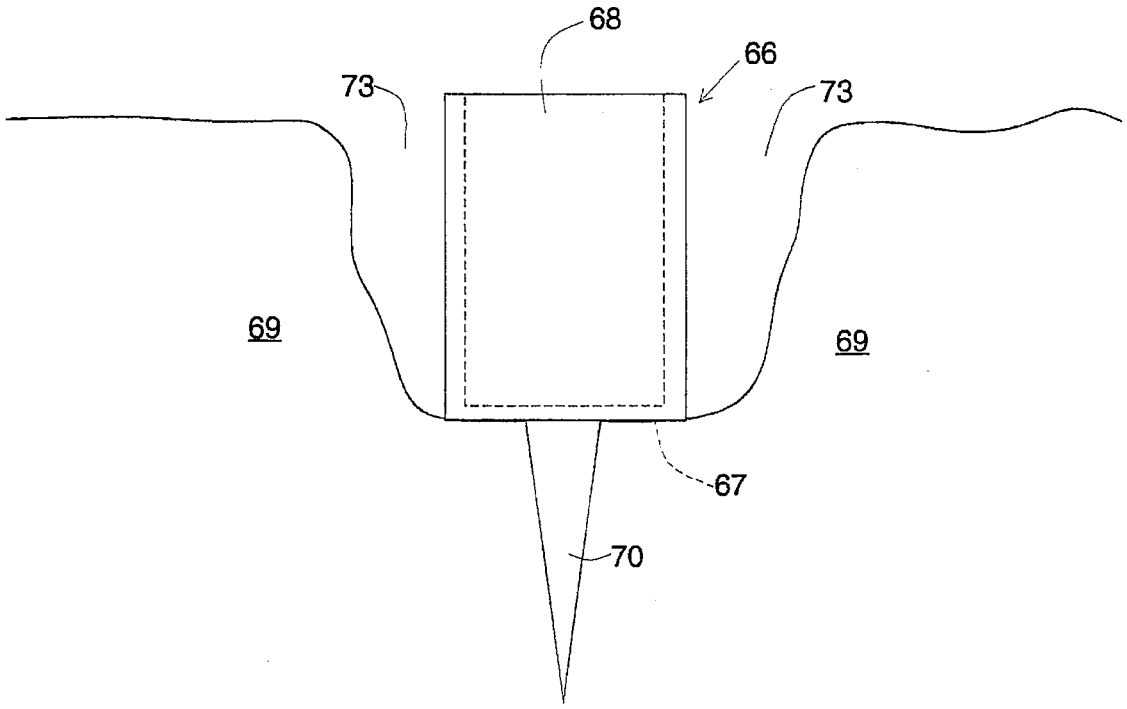
FIG. 6A is an elevational view of the post support in a cross-sectional view of the surrounding earth, shown with the hole dug to receive the post support.

FIG. 6A is an elevational view of the post support 66 in a cross-sectional view of surrounding undisturbed earth 69, shown with a hole 73 dug to receive the post support 66. The post support 66 includes a substantially cup-shaped post receiving member 68, the post receiving member 68 having a base 67. A post support spike 70 depends outwardly from the center of the base 67. The post support spike 70 is driven into the undisturbed earth 69.

Figure 6B:
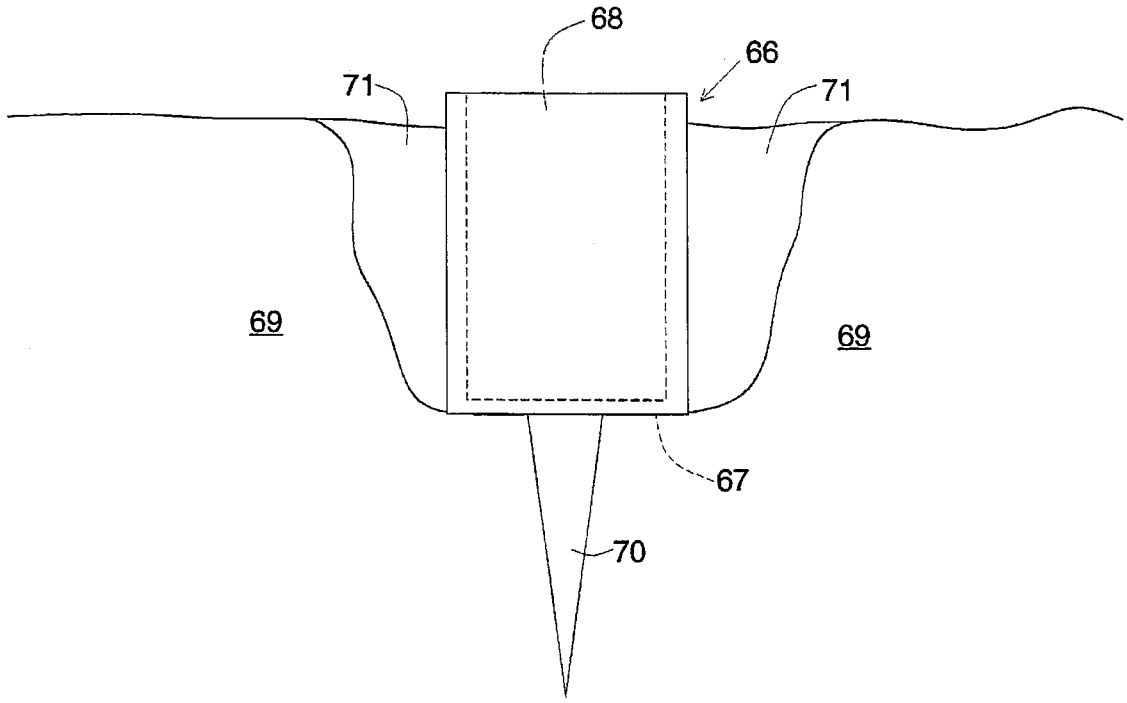
FIG. 6B is the same view as FIG. 6A, except that the hole is filled.

FIG. 6B is the same view as FIG. 6A, except that the hole 73 is filled with earth 71 around the post receiving member 68. As shown in FIG. 5, the post 16 is inserted into the post receiving member 68.

In the preferred embodiment, the post receiving member 68 is about five inches long and the post support spike 70 is about four inches long. These dimensions may vary and still remain within the scope of the present invention.

Figure 7:
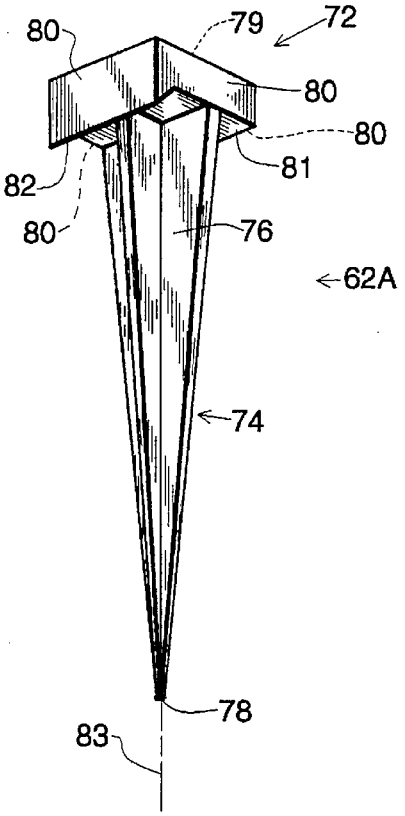
FIG. 7 is a perspective view of the anchor.
Figure 8:
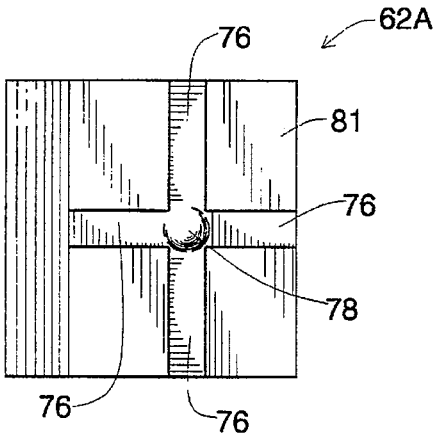
FIG. 8 is a bottom elevational view of the anchor.

FIG. 7 is a perspective view of the first anchor 62A. FIG. 8 is a bottom elevational view of the first anchor 62A. Referring to FIGS. 5, 7 and 8, the first anchor 62A includes an anchor head 72 at one end thereof. The anchor head 72 is substantially box shaped, having four side faces 80, a top face 79 and a bottom face 81. An anchor spike 74 depends outwardly from the bottom face 81. The anchor spike 74 comprises four fins 76, each fin 76 disposed at a 90 degree angle to each adjacent fin 76. The four fins 76 are connected to one another along a central axis 83 of the anchor spike 74. The anchor spike 74 tapers from a wide end adjacent to the bottom face 81 to a narrow end 78. The first anchor 62A includes an anchor head lip 82 depending outwardly from said bottom face 81. The second anchor 62B is configured similarly to the first anchor 62A.

Figure 9:
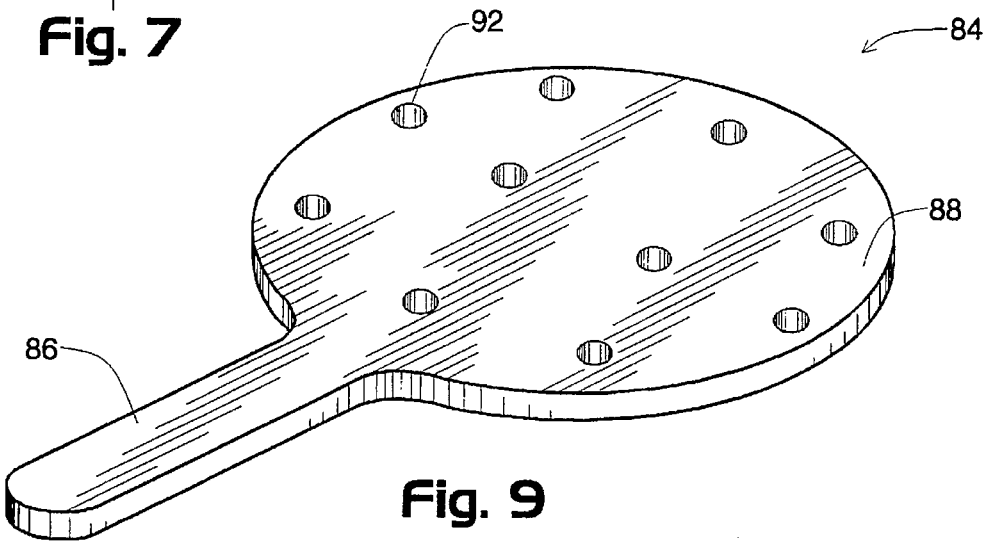
FIG. 9 is a perspective view of the paddle.

FIG. 9 shows the paddle 84. In the preferred embodiment, the paddle 84 includes a substantially round paddle head 88. The paddle head 88 has structure forming a plurality of air holes 92 there-through to decrease air resistance when the paddle 84 is moved through the air during game play.

A handle 86 depends outwardly from the paddle head 88. The handle 86 is continuous and coplanar with the paddle head 88.

In the preferred embodiment: the paddle head 88 is about ten inches in diameter and the handle 86 is about 6 inches long by 1 inch wide; the thickness of the paddle head 88 and the handle 86 is about three-quarters of an inch; and the paddle 84 weighs about 15 ounces. The weight of the paddle 84 may vary from about 10 to 20 ounces. The dimensions, shape and configuration of the paddle 84 may vary and still remain within the scope of the present invention.

Figure 10:
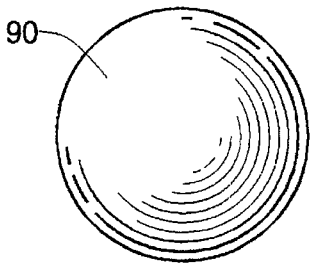
FIG. 10 is a perspective view of the projectile.

FIG. 10 shows the projectile 30. In its preferred embodiment, the projectile 30 is substantially spherically shaped, is made of sponge-like material, is four inches in diameter, and weighs about 1.5 to 3 ounces. The material, dimensions and weight of the projectile 30 may vary and still remain within the scope of the present invention.

Referring again to FIG. 1, two first serve fines 94 are marked on the hard surface 26 with chalk. The serve lines 94 are parallel to the barrier 10. The first serve lines 94 and sides 96 of the hard surface 26 define the limits of a substantially rectangular in-bounds area.

The length of the in-bounds area is preferably thirty to forty feet, with the barrier 10 dividing the in-bounds area into two equal areas. The length of the in-bounds area may vary and still remain within the scope of the present invention.

Two second serve lines 97 are marked on the hard surface 26 with chalk. The second serve lines 26 are parallel to the barrier 10. The second serve lines 26 are each located mid-way between the first serve line 94 and the barrier 10.

The game is played by two players 29. The players 29 choose who will begin a volley for serve to start the game.

The player 29 who begins the volley hits the projectile 30 over the barrier 10 to the other player 29. The players 29 hit the projectile 30 back and forth. The player 29 who fails to hit the projectile 30 back over the barrier 10 becomes a defensive player, and the other player 29 becomes an offensive player. The player 29 who hits the projectile 30 out of bounds becomes the defensive player and the other player 29 becomes the offensive player. During the volley, the projectile 30 must go over the barrier 10 at least twice, or the volley must begin again.

After the volley is completed, the offensive player serves the projectile 30. There are four types of serves which the offensive player may perform. The drive serve is executed by throwing the projectile 30 against the hard surface 26 so that the projectile 30 bounces upward, then hitting the projectile 30 as hard as possible directly over the barrier 10. The drive serve may also be executed by throwing the projectile 30 upward, then hitting the projectile 30 against the hard surface 26 on the offensive player's side of the barrier 10 so that the projectile 30 bounces once and then goes over the barrier 10. The drive serve must be executed from behind the first serve line 94.

The offspin serve is executed by throwing the projectile 30 against the hard surface 26 so that the projectile 30 bounces upward, then by hitting the underside of the projectile 30 with a swiping motion, so as to impart spin to the projectile 30 and to propel the projectile 30 over the barrier 10. The offspin serve may be executed from behind the first serve line 94 and from behind the second serve line 97.

The crossover serve is executed by throwing the projectile 30 against the hard surface 26 so that the projectile 30 bounces upward, then by hitting the top of the projectile 30 with a swiping motion, so as to impart spin to the projectile 30 and to propel the projectile 30 over the barrier 10. The crossover serve may be executed from behind the first serve line 94 and from behind the second serve line 97.

The launch serve is executed by throwing the projectile 30 against the hard surface 26 so that the projectile 30 bounces upward, then by hitting the underside of the projectile 30 to propel the projectile 30 as high into the air as possible and over the barrier 10. The launch serve may be executed from behind the first serve line 94 and from behind the second serve line 97.

Each of the above described serves requires that the projectile 30 hit the hard surface 26 on the offensive player's side of the barrier 10 before the projectile 30 goes over the barrier 10.

After the projectile 30 is served, the players 29 use the paddles 28 to hit the projectile 30 back and forth over the barrier 10. The offensive player gains a point and serves again if any of the following occurs: the defensive player fails to hit the projectile 30 back over the barrier 10; the defensive player hits the projectile 30 out of bounds.

The present defensive player becomes the new offensive player and the present offensive player becomes the new defensive player when any one of the following occurs: the offensive player fails to serve the projectile 30 over the barrier 10; the offensive player fails to hit the projectile 30 back over the barrier 10; the offensive player hits the projectile 30 such that said projectile 30 lands out of bounds.

The new offensive player serves the projectile 30 to the new defensive player.

When the projectile 30 clears the barrier 10 while going over the barrier 10, then the projectile 30 hits the hard surface 26 at least twice, the player 29 is restricted from hitting the projectile 30 back over the barrier 10.

When the projectile 30 touches the barrier 10 while going over the barrier 10, then the projectile 30 hits the hard surface 26 at least three times, the player 29 is restricted from hitting the projectile 30 back over the barrier 10.

Each player 29 is restricted from hitting the projectile 30 more than once before the other player 29 touches said projectile.

CONCLUSION, RAMIFICATIONS AND SCOPE

Thus the paddle ball game of the present invention is suitable for play by children or adults using a residential driveway as the playing area.

While the above description contains many specifics, these should not be construed as limitations on the scope of the invention, but rather as an exemplification of one preferred embodiment thereof. Many variations are possible, for example: the method and structure for supporting and anchoring the posts 16 may vary; the method and structure for attaching the barrier 10 to the posts 16 may vary; and the anchors 62A and 62B may be deleted if the supports 66 are made deep enough to hold the posts 16 securely.

Accordingly, the scope of the invention should be determined not by the embodiment illustrated, but by the appended claims and their legal equivalents.

The invention claimed is:

1. A paddle game apparatus comprising:

a. at least two posts;

b. each of said posts including a post support means for supporting said post in a substantially vertical position;

c. a thin, flexible barrier for extending between said posts, said barrier having a top edge, a bottom edge, a first end and a second end;

d. at least two first attachment means for attaching said barrier to said post near said top edge of said barrier;

e. at least two second attachment means for attaching said barrier to said post near said bottom edge of said barrier;

f. at least two paddles and a projectile;

g. at least four top grommets positioned near said top edge of said barrier and positioned substantially equidistant from each other and distributed from near the first end of said barrier to near the second end of said barrier, whereby a cord may be laced through each of said top grommets to support said barrier substantially along its entire length, and said cord may be attached to each of said first attachment means.

2. The paddle game apparatus of claim 1, wherein said second attachment means comprises:

a. a first outer bottom grommet positioned near said first end and near said bottom edge of said barrier;

b. a second outer bottom grommet positioned near said second end and near said bottom edge of said barrier;

c. a first post-to-outer bottom grommet attachment means for attaching said first outer bottom grommet to said post; and d. a second post-to-outer bottom grommet attachment means for attaching said second outer bottom grommet to said post.

3. The paddle game apparatus of claim 2, wherein:

a. said first and second attachment means are positioned to support said barrier such that said top edge of said barrier is about eighteen to thirty-six inches above grade;

b. said paddle weighs about 10 to 20 ounces; and c. said projectile is substantially spherical is made of sponge-like material and weighs about 1.5 to 3 ounces, whereby a game played with the paddle game apparatus by striking the projectile back and forth with the paddles may be played by children or adults using a residential driveway of approximately 30 to 40 feet in length as a playing area.

4. The paddle game apparatus of claim 2, said barrier further comprising an inner bottom grommet positioned a pre-determined distance inboard of each of the first outer bottom grommet and the second outer bottom grommet, said inner bottom grommet positioned substantially opposite one of said top grommets, whereby said barrier may be shortened by cutting said barrier outboard of and near each of said inner bottom grommets, and said first and second post-to-outer bottom grommet attachment means may be attached to said inner bottom grommets.

5. The paddle game apparatus of claim 2, wherein said first attachment means comprises:

a. a post ring attached to said post;

b. a barrier connector having a barrier connector body;

c. said barrier connector body having a closed ring at a first end of said barrier connector body, said closed ring for connecting to said cord by tying said cord to said closed ring;

d. said barrier connector body having a latch ring at a second end of said barrier connector body, said latch ring for connecting to said post ring;

e. said latch ring being substantially c-shaped;

f. a latch ring lip depending outwardly from an intersection of said barrier connector body and said latch ring;

g. a gate pivotally attached to an extreme fixed end of said latch ring by a fastener; and h. said gate extending to an interior side of said latch ring lip.

6. A method of playing a paddle ball game, comprising the steps of:

a. providing a hard surface;

b. defining a substantially rectangular in-bounds area on said hard surface;

c. providing a thin rectangular barrier supported between two posts, such that the plane of said barrier is substantially perpendicular to said hard surface and such that said barrier divides said in-bounds area into two equal areas;

d. defining two first serve lines on said hard surface, said first serve lines positioned at the extreme ends of said in-bounds area on each side of said barrier, said first serve lines being parallel to said barrier;

e. defining two second serve lines on said hard surface, said second serve lines disposed on opposite sides of said barrier, said second serve lines each positioned mid-way between said first serve line and said barrier, said second serve lines being parallel to said barrier;

f. providing at least two paddles;

g. providing a projectile;

h. providing at least two players;

i. said players choosing who will begin a volley for serve to start said game;

j. said player who begins said volley using said paddle to hit said projectile over said barrier to other said player;

k. said players using said paddles to hit said projectile back and forth over said barrier;

l. said player who fails to hit said projectile back over said barrier becoming a defensive player, the other of said players becoming an offensive player;

m. said player who hits said projectile such that said projectile lands out of bounds becoming the defensive player, the other of said players becoming the offensive player;

n. said offensive player serving said projectile to said defensive player;

o. permitting a plurality of methods of serving, each of said methods of serving requiring that said projectile hit said hard surface on said offensive player's side of said barrier before said projectile goes over said barrier;

p. permitting at least one of said methods of serving to be executed from said first serve line only;

q. permitting at least one of said methods of serving to be executed from said first serve line and from said second serve line;

r. after said projectile is served, said players using said paddles to hit said projectile back and forth over said barrier;

s. when said defensive player fails to hit said projectile back over said barrier, said offensive player gaining a point and then serving said projectile again;

t. when said defensive player hits said projectile back over said barrier such that said projectile lands out of bounds, said offensive player gaining a point and then serving said projectile again;

u. present said defensive player becoming new said offensive player and present said offensive player becoming new said defensive player when present said offensive player fails to serve said projectile over said barrier;

v. present said defensive player becoming new said offensive player and present said offensive player becoming new said defensive player when present said offensive player fails to hit said projectile back over said barrier;

w. present said defensive player becoming new said offensive player and present said offensive player becoming new said defensive player when present said offensive player hits said projectile such that said projectile lands out of bounds;

x. new said offensive player serving said projectile to new said defensive player;

y. when said projectile clears said barrier while going over said barrier, then said projectile hits said hard surface at least twice, said player being restricted from hitting said projectile back over said barrier;

z. when said projectile touches said barrier while going over said barrier, then said projectile hits said hard surface at least three times, said player being restricted from hitting said projectile back over said barrier; and aa. play continuing until one of said players reaches a pre-determined number of points.

7. The method of playing a paddle ball game of claim 6, wherein:

a. a top edge of said barrier is about eighteen to thirty-six inches above grade;

b. said paddle weighs about 10 to 20 ounces;

c. said projectile is substantially spherical, is made of sponge-like material and weighs about 1.5 to 3 ounces; and d. said in-bounds area is about 30 to 40 feet in length.

* * * * *